US010363589B2

(12) United States Patent
Jaeger et al.

(10) Patent No.: US 10,363,589 B2
(45) Date of Patent: Jul. 30, 2019

(54) METHOD AND PLANT FOR PRODUCING EXTRUSION BILLETS

(71) Applicant: Ulrich Bruhnke, Ehningen (DE)

(72) Inventors: Andreas Jaeger, Dortmund (DE); Karl-Heinz Lindner, Muelheim (DE); Ralf Anderseck, Grafendorf (DE)

(73) Assignee: Ulrich Bruhnke, Ehningen (DE)

( * ) Notice: Subject to any disclaimer, the term of this patent is extended or adjusted under 35 U.S.C. 154(b) by 226 days.

(21) Appl. No.: 15/102,183

(22) PCT Filed: Nov. 27, 2014

(86) PCT No.: PCT/DE2014/000605

§ 371 (c)(1),
(2) Date: Jun. 6, 2016

(87) PCT Pub. No.: WO2015/081924

PCT Pub. Date: Jun. 11, 2015

(65) Prior Publication Data

US 2016/0303630 A1 Oct. 20, 2016

(30) Foreign Application Priority Data

Dec. 5, 2013 (DE) ..... 10 2013 020 319

(51) Int. Cl.

| | |
|---|---|
| ***B21C 23/01*** | (2006.01) |
| ***B21C 33/00*** | (2006.01) |
| ***B30B 9/32*** | (2006.01) |
| ***B21C 23/00*** | (2006.01) |

(52) U.S. Cl.
CPC ..... *B21C 33/00* (2013.01); *B21C 23/001* (2013.01); *B30B 9/327* (2013.01)

(58) Field of Classification Search
CPC ..... B21C 23/002; B21C 23/01; B21C 27/04; B21C 23/04; B22F 3/16; B22F 3/162; B30B 9/327
See application file for complete search history.

(56) References Cited

U.S. PATENT DOCUMENTS

| | | | | |
|---|---|---|---|---|
| 2,391,752 A | | 12/1945 | Stern | |
| 3,626,578 A | | 12/1971 | Price et al. | |
| 4,028,795 A | * | 6/1977 | Takahashi | B21C 27/04 29/403.2 |
| 4,033,024 A | * | 7/1977 | Takahashi | B21C 23/01 29/403.2 |

(Continued)

FOREIGN PATENT DOCUMENTS

| | | |
|---|---|---|
| DE | 1929986 A1 | 1/1970 |
| DE | 2518935 A1 | 7/1976 |

(Continued)

*Primary Examiner* — Debra M Sullivan
(74) *Attorney, Agent, or Firm* — Smartpat PLC

(57) ABSTRACT

A method and a system produces extrusion billets from scraps obtained from stamping, cutting and/or machining operations, in particular scraps made of magnesium or magnesium alloys, without subjecting these to a melting process. The system for carrying out the method is essentially composed of a storage unit for the scraps, a device for comminuting the scraps, a press for producing a round briquette, and an extruder for shaping the round briquette into a extrusion billet.

6 Claims, 1 Drawing Sheet

(56) References Cited

U.S. PATENT DOCUMENTS

| | | | | | |
|---|---|---|---|---|---|
| 4,059,896 | A * | 11/1977 | Asari | B21C 23/002 | 29/403.2 |
| 4,117,703 | A * | 10/1978 | Takahashi | B21C 23/002 | 29/403.2 |
| 2006/0165833 | A1* | 7/2006 | Muschalik | B21C 23/12 | 425/296 |
| 2007/0169859 | A1* | 7/2007 | Kawamura | C22C 23/04 | 148/667 |
| 2015/0066135 | A1* | 3/2015 | Weber | A61F 2/82 | 623/1.38 |

FOREIGN PATENT DOCUMENTS

| | | |
|---|---|---|
| DE | 102008038966 | 8/2009 |
| DE | 102012002009 | 8/2013 |
| EP | 0367859 | 5/1990 |
| WO | 2013113299 | 8/2013 |

* cited by examiner

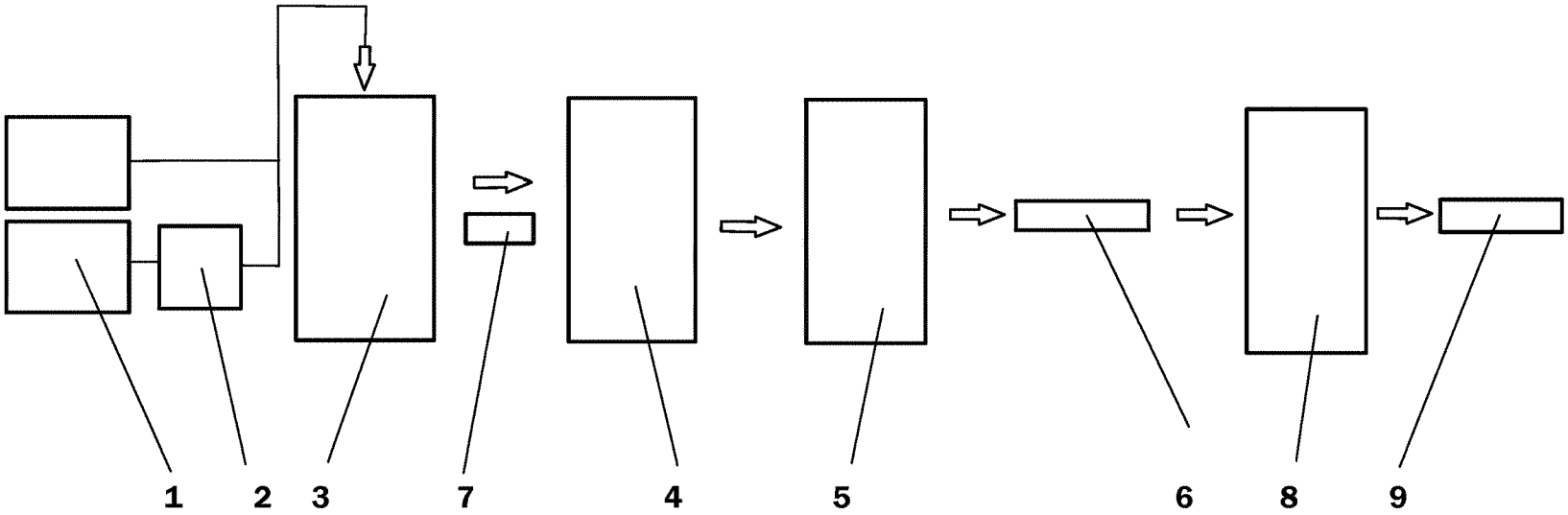
1
2
3
7
4
5
6
8
9

METHOD AND PLANT FOR PRODUCING EXTRUSION BILLETS

BACKGROUND OF THE INVENTION

The invention relates to a method and to a system for producing extrusion billets for the extrusion of profiles made of magnesium or magnesium alloys.

When semi-finished products and components made of magnesium or magnesium alloys are produced, chips or stamping or cutting scraps are incurred both in machining operations and in stamping or cutting operations.

The material remnants that are incurred still have the same material properties as the produced semi-finished products or components.

Such material remnants are usually collected and recycled by melting these down.

So as to render material remnants easier to handle for disposal and recycling and achieve greater efficiency in the melting process, the loose chips are compressed to form metal briquettes.

A briquetting press that can be used for this purpose is known from EP 0367 859 A1, for example. So as to produce dimensionally stable briquettes, the briquetting press comprises a pre-compressing chamber and a downstream compressing chamber. The material to be pressed is supplied via a feed screw to a pre-compacting plunger, whereby the receiving chamber is filled to the desired level. Subsequently, a ram is actuated for compacting the material.

A further device for compressing metal chips to form metal briquettes is known from DE 10 2008 038 966 B3. The device for compressing the metal chips to form metal briquettes comprises a storage container for the metal chips, which has a paddle wheel disposed downstream thereof. The paddle wheel feeds the metal chips to a pre-compressing chamber. Downstream of the pre-compressing chamber is a compressing chamber, in which the pre-compressed metal chips are then compressed to form metal briquettes and subsequently fed to the melting process. Stamping or cutting scraps cannot be processed in this way since these have significantly larger geometric dimensions than metal chips. The disadvantage in this regard is not only the high complexity involved with collecting, storing and pretreating the cutting remnants, but also the high energy expenditure for melting these for re-use.

U.S. Pat. No. 2,391,752 describes a method for producing finished products, such as tubes, rods and profiles, from aluminum or aluminum alloy scraps, comprising the steps of compressing the scraps and maintaining these at a temperature of approximately 300° C. and a pressure of approximately 3 to 8 tons per square inch, whereby oxide films of the waste particles are disrupted and new metallic contact surfaces are formed, subsequently the temperature is increased to approximately 350° C. to 450° C., and the finished products are shaped in a compression device at a pressure of approximately 18 to 40 tons per square inch.

A device and a method for producing non-porous profiles from cutting remnants by way of extrusion are known from DE 10 2012 002 009 A1. The device comprises an extruder including a compaction chamber, a stem, a press the and a container which can be filled with aggregate material consisting of cutting remnants from cutting manufacturing methods or the like, such as chips or waste material. Between the press the and the compaction chamber, the device comprises a cover element, which seals the compaction chamber on the press die side, and against which the stem compacts the aggregate material consisting of cutting remnants to form a briquette and removes fluid inclusions remaining in the compaction chamber and in the aggregate material. After the cover element is removed, the compacted briquette is extruded through the press the as a profile cross-section.

Compaction to obtain a briquette is carried out in the compaction chamber, the open end of which can be sealed with respect to the press die, by applying heat and using consistent hydrostatic pressure conditions for a predefinable period of time to obtain a briquette.

The disadvantage here is the relatively long extruder idle time during the production of the extruded profiles since a new briquette must be produced from cutting remnants on the same extruder every time the briquette has been shaped into a profile by way of the press die. This results in relatively long the times for the actual production of the profile and the further processing of the profiles subsequent thereto. A further disadvantage is that the cover element between the end of the compaction chamber and the press the must be pivoted in or pushed in. Since it must seal the compression chamber on the one hand, and clear the way to the press die during the extrusion process on the other hand, installation of the same into an existing extruder system is associated with increased complexity.

The majority of extruder systems use horizontally disposed stems and containers. Due to this configuration, adding cutting remnants is relatively difficult and the fill level is unsatisfactory.

SUMMARY OF THE INVENTION

The invention addresses the problem of producing the extrusion billets required for the extrusion process from scraps obtained from stamping, cutting and/or machining operations, and more particularly without the scraps being subjected to a melting process. The invention covers numerous design elements, both in the process and in the infrastructure of the plant. When used in an integrated manner, these elements allow a very efficient and extremely environmentally friendly in-house recycling process. These elements are:

1. The invention relates in particular to magnesium alloys, which undergo dynamic recrystailization very well and are fed to the recycling process in pure form.
2. The entire manufacturing building, including the recycling system installed therein, is air-conditioned so that increased oxide formation, or even hydroxide formation, is prevented. This is generally achieved by limiting the relative humidity.
3. Dry and chemical-free stamping scraps or chips enter the recycling process.
4. For safety reasons, the scraps are comminuted, not by way of tearing processes, but rather cutting processes. This avoids the development of hazardous amounts of dust.

According to the invention, the method for producing extrusion billets from scraps obtained from stamping, cutting and/or machining operations comprises the following steps:

removing the scraps from a storage unit, wherein the scraps obtained from the stamping or cutting operation are comminuted by way of a device and subsequently optionally mixed with the scraps from machining operations;

filling the round compression mold with the scrap mixture and compressing (compacting) the scrap mixture to form a round briquette having a density of more than 60%;

heating the round briquette to a temperature above 250° C.; and introducing the round briquette into the container of an extruder and compression molding an extrusion billet having a density of greater than 95%.

In addition, it is possible to subject the scrap mixture to a pre-compaction process prior to filling the round compression mold.

According to the invention, the system for producing extrusion billets from scraps obtained from stamping, cutting and/or machining operations comprises a storage unit for the scraps, a device for comminuting the scraps, a press for producing a round briquette, a furnace for heating the round briquette, and an extruder for producing the extrusion billet. The storage unit may be configured so that chambers are provided for scraps having differing geometric dimensions. Chips have a relatively fine grain size and can thus be loaded directly into the press, while stamping or cutting scraps are comminuted to a suitable size by way of a device.

The device for comminuting the scraps preferably operates based on a cutting method, whereby the development of dust is minimized. Optionally, the scraps from the individual chambers may be mixed and delivered into the press by way of a pre-compacting unit. The pre-compacting unit is preferably heated and designed as a screw compacter.

The scraps loaded into these compression cylinders of the press are compacted there to obtain a round briquette having a density of more than 60%. Compacting in the press is followed by heating the round briquette and extruding the round briquette in a regular extruder to obtain an extrusion billet strand, which is cut to an appropriate length after exiting the press die. As a result of the use of dies in which the material is deflected one or several times under the action of a pressing force, an improvement in the groin size is achieved within the material during the pressing operation under shearing strain (multiple shearing and accumulation of shear stresses). Optionally, the extrusion billet can be homogenized out at a temperature above 400° C. for a duration of approximately 6 hours.

The finished extrusion billets then have a density of greater than 95% and can be temporarily stored or immediately processed further into finished extruded profiles on the extrusion lines. This has the advantage that the idle times on the extrusion lines are limited to the time for replacing the extrusion billet. The finished extrusion billets made of the recycled material (scraps) have properties that statically, dynamically and alternately meet the specification of the alloy and can therefore be used equivalently in addition to the primarily produced extrusion billets.

Especially in the automobile construction field today, a large number of components are used that are produced from extruded profiles. Because of the lightweight construction, magnesium or magnesium alloys lend themselves to this purpose.

These are frequently produced in large-scale plants including multiple press and machining lines, resulting also in an accordingly larger amount of scrap materiel. Magnesium alloys having a low stacking fault energy are optimal for processing, allowing good dynamic recrystallization. These are the advantages of the invention. Since larger amounts of scrap material are incurred, these no longer have to be transported to the material producers for melting and for casting new semi-finished products, but can be shaped into new extrusion billets within the production facility.

The invention will be described in more detail based on exemplary embodiments.

BRIEF DESCRIPTION OF THE DRAWING

The drawing shows a schematic of the system according to the invention.

DETAILED DESCRIPTION OF THE INVENTION

The drawing shows a schematic of the system according to the invention for producing extrusion billets 6. This system is essentially composed of a storage unit for the scrap material from ongoing production. Since one and the same material, this being a magnesium alloy, and preferably an alloy with the designation MnE21®, is used for the entire production, the scrap material is also pure scrap.

The scraps are accommodated in the storage unit 1 separated according to the geometric dimensions thereof. Scraps having a smaller grain size, for example from machining, can be delivered directly into the press 3. Scraps having larger geometric dimensions, for example stamping scraps or clippings, are comminuted into scraps having a suitable grain size by way of a device 2. These can then either be delivered into the press 3 or mixed with other scrap, for example chips.

The press 3 is designed as a mechanical press having a vertical round compression mold. The vertical design simplifies the filling of the compression mold and also enables maximum filling. A compression unit comprising multiple juxtaposed compression molds would also be conceivable. Under the action of a pressing force on the filled-in content of the compression mold, a round briquette having a density of more than 60% is created.

The round briquettes 7 produced are heated in a furnace 4 to a temperature of approximately 450° C. Subsequently, the heated round briquette 7 is introduced into the hopper of the extruder 5 and deformed under application of pressure to obtain an extrusion billet 6 or extrusion billet strand. If an extrusion billet strand is used, it can be cut to the appropriate length after leaving the die, for example by way of a flying saw. The resulting extrusion billet has a density of greater than 95%.

Thereafter, the extrusion billet can be further processed into appropriate profiles 9 in an extruder 8 on the press line or be temporarily stored. Optionally, the extrusion billet can be homogenized at a temperature above 400° C. for a duration of approximately 6 hours.

The invention claimed is:

1. A method for producing profiles from magnesium or magnesium alloy scraps obtained from stamping, cutting and/or machining operations, comprising:

removing the scraps from a storage unit;

filling a round compression mold with the scraps;

compressing the scraps to obtain a round briquette having a density of greater than 60%;

heating the round briquette in a furnace to a temperature above 250° C.;

introducing the heated round briquette into an extruder and, under pressure, extruding the round briquette through a first die into an extrusion billet having a density of greater than 95%, wherein the round briquette is deflected one or several times under the action of a pressing force and formed into the extrusion billet;

cutting the extrusion billet;

homogenizing the extrusion billet at a temperature above 400° C. for a predetermined time period; and extruding the extrusion billet through a second die into a profile.

2. The method according to claim 1, further comprising comminuting the scraps before filling the round compression mold with the scraps prior to filling the round compression mold.

3. A system for producing profiles from magnesium or magnesium alloy scraps obtained from stamping, cutting and/or machining operations comprising, in the following order, a storage unit for the scraps, a cutter for comminuting the scraps, a press for producing round briquettes, a furnace for heating the round briquettes, an extruder for extruding extrusion billets from the round briquettes, the extruder being configured to deflect the round briquettes one or several times under the action of a pressing force, and a second extruder for extruding the extrusion billets into profiles.

4. The system according to claim 3, wherein the cutting device for comminuting the scraps is disposed between the storage unit and the press.

5. The system according to claim 3, wherein the press comprises at least one vertical round compression mold.

6. The system according to claim 4, wherein the press comprises at least one vertical round compression mold.

* * * * *